US011359787B2

(12) United States Patent
Lee et al.

(10) Patent No.: US 11,359,787 B2
(45) Date of Patent: Jun. 14, 2022

(54) LAMP FOR VEHICLE

(71) Applicant: SL Corporation, Daegu (KR)

(72) Inventors: Jeong Su Lee, Gyeongsan-si (KR); Jong Woon Kim, Gyeongsan-si (KR); Nak Jung Choi, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/387,315

(22) Filed: Jul. 28, 2021

(65) Prior Publication Data

US 2022/0065418 A1 Mar. 3, 2022

(30) Foreign Application Priority Data

Aug. 25, 2020 (KR) ..... 10-2020-0107182

(51) Int. Cl.

| | |
|---|---|
| ***F21V 1/04*** | (2006.01) |
| ***F21S 41/275*** | (2018.01) |
| ***F21S 41/32*** | (2018.01) |
| ***F21S 41/255*** | (2018.01) |
| *F21W 107/10* | (2018.01) |
| *F21S 41/148* | (2018.01) |
| *F21Y 115/10* | (2016.01) |

(52) U.S. Cl.

CPC ..... *F21S 41/275* (2018.01); *F21S 41/255* (2018.01); *F21S 41/321* (2018.01); *F21S 41/148* (2018.01); *F21W 2107/10* (2018.01); *F21Y 2115/10* (2016.08)

(58) Field of Classification Search

CPC ..... G02B 27/0961; G02B 3/0006; G02B 3/0068; G02B 3/00; F21V 5/004; F21V 5/00; F21V 5/007; F21S 41/25; F21S 41/255; F21S 41/27; F21S 41/265; F21S 41/285; F21S 41/151; F21W 2107/10; F21W 2102/00; F21W 2102/13; F21W 2107/00

See application file for complete search history.

(56) References Cited

U.S. PATENT DOCUMENTS

2018/0106450 A1* 4/2018 Kamau ..... F21S 41/265
2018/0335191 A1* 11/2018 Stefanov ..... F21S 41/635

FOREIGN PATENT DOCUMENTS

KR 20180078951 A * 7/2018 ..... F21S 41/265
WO WO-2017066818 A1 * 4/2017 ..... F21V 11/186

* cited by examiner

*Primary Examiner* — Omar Rojas Cadima
(74) *Attorney, Agent, or Firm* — United One Law Group LLC; Kongsik Kim; Jhongwoo Peck

(57) ABSTRACT

A vehicle lamp includes a light emission system; and an optical system disposed in front of the light emission system. The optical system is configured to allow light incident thereto from the light emission system to exit through a plurality of optical modules to form a predefined light irradiation pattern, and each of the plurality of optical modules includes an incident lens and an exit lens. Further, the light emission system includes a plurality of light sources; and a plurality of reflectors configured to allow a plurality of light beams respectively emitted from the plurality of light sources to be respectively directed to a plurality of regions of the optical system.

14 Claims, 17 Drawing Sheets

LAMP FOR VEHICLE

CROSS-REFERENCE TO RELATED APPLICATION

This application claims priority to Korean Patent Application No. 10-2020-0107182 filed on Aug. 25, 2020, which application is herein incorporated by reference in its entirety.

BACKGROUND

1. Technical Field

The present disclosure relates to a lamp for a vehicle, and more particularly, to a lamp for a vehicle capable of forming a light irradiation pattern that includes a plurality of pattern images while simplifying a configuration thereof.

2. Description of Related Art

A vehicle is equipped with various types of the lamps having an illumination function for easily identifying objects located around the vehicle during low light conditions (e.g., night driving), and a signaling function to inform a driver of another vehicle or a pedestrian around the vehicle of a driving state of the vehicle.

For example, head lamps and fog lamps are mainly intended for the illumination functions. Turn signal lamps, tail lamps, brake lamps, etc. are mainly for the signaling functions. Installation standards of the lamps and standards of the lamps are stipulated by laws and regulations to fully exhibit corresponding functions.

Recently, research is being actively conducted to reduce a size of the lamp using a micro-lens with a relatively short focal point distance. In this case, a light irradiation pattern having a required shape or size is formed by light emitted from several micro-lenses.

When the light irradiation pattern includes a plurality of pattern images, each optical system for forming each pattern image needs to be separately provided. Accordingly, a configuration of the lamp becomes complicated, and a cost thereof increases.

Thus, there is a need for a lamp capable of forming a light irradiation pattern including a plurality of pattern images while a configuration of the lamp is simplified.

SUMMARY

An object of the present disclosure is to provide a lamp for a vehicle that may easily form a plurality of pattern images without having to separately provide each optical system for forming each pattern image when forming a light irradiation pattern including the plurality of pattern images.

Objects in accordance with the present disclosure are not limited to the above-mentioned object. Other objects and advantages in accordance with the present disclosure as not mentioned above may be understood from the following descriptions and more clearly understood from embodiments in accordance with the present disclosure. Further, it will be readily appreciated that the objects and advantages in accordance with the present disclosure may be realized by features and combinations thereof as disclosed in the claims.

According to an aspect of the present disclosure, a vehicle lamp may include a light emission system; and an optical system disposed in front of the light emission system. The optical system may allow light incident thereto from the light emission system to exit through a plurality of optical modules to form a predefined light irradiation pattern, and each of the plurality of optical modules may include an incident lens and an exit lens. Further, the light emission system may include a plurality of light sources; and a plurality of reflectors configured to allow a plurality of light beams respectively emitted from the plurality of light sources to be respectively directed to a plurality of different regions of the optical system.

The plurality of reflectors may respectively reflect the plurality of light beams emitted from the plurality of light sources to cause them to travel substantially in parallel with a line that passes through a center of the optical system in a front and rear direction.

The optical system may irradiate the plurality of light beams that are respectively reflected from the plurality of reflectors to a plurality of positions having different distances from the vehicle. The plurality of reflectors may have different sizes. The plurality of regions may also have different sizes, and each of the plurality of reflectors may have a same size as a corresponding region among the plurality of regions. The plurality of regions may have different sizes, that vary based on distances between the vehicle and points to which the plurality of light beams from the plurality of regions are irradiated.

Further, the plurality of regions may be arranged in a vertical direction, and a region among the plurality of regions, which irradiates a light beam to a point disposed farther from the vehicle than any other regions, may be formed larger than any other regions. The region may correspond to an uppermost or a lowermost region among the plurality of regions.

Directions of light beams that are irradiated from different optical modules belonging to different regions of the optical system may have different tilt angles with respect to a horizontal direction. By way of example, a light beam, which is irradiated to a point disposed farther from the vehicle than any other light beams, may be irradiated in a direction tilted with respect to the horizontal direction by a tilt angle that is smaller than any other light beams.

Each of the plurality of light sources may be disposed on one side of each of the plurality of reflectors such that each light beam is emitted in a left and right direction. The plurality of light sources may be turned on or off simultaneously. Alternatively, the plurality of light sources may be turned on or off sequentially. At least two of the plurality of light sources may respectively generate at least two light beams having different brightness.

The plurality of optical modules may further include a plurality of shields having transmissive regions formed therein to transmit at least a portion of the plurality of light beams, and a transmissive region, which transmits a light beam to a position disposed farther from the vehicle than any other light beams, is formed larger than any other transmissive regions.

According to a related aspect of the present disclosure, a lamp for a vehicle may include a light emission system; and an optical system disposed in front of the light emission system. The optical system may allow light incident thereto from the light emission system to exit through a plurality of optical modules to form a predefined light irradiation pattern, and each of the plurality of optical modules may include at least one incident lens and at least one exit lens. In particular, the light emission system may include at least one light source; and at least one reflector configured to allow a plurality of light beams emitted from the at least one light source to be respectively directed to a plurality of regions formed in the optical system. Further, a region among the plurality of regions, which irradiates a light beam to a point disposed farther from the vehicle than any other light beams, may be formed larger than any other regions. An irradiation direction of the light beam, which is irradiated to the point disposed farther from the vehicle than any other light beams, may be tilted with respect to a horizontal direction by a tilt angle that is smaller than any other light beams.

According to the lamp for the vehicle according to the present disclosure as described above, one or more of the following effects may be provided. The plurality of optical modules may irradiate light beams in different directions, based on a location where each of the plurality of pattern images included in the optical irradiation pattern is formed. Thus, the plurality of pattern images may be easily formed while a configuration of the lamp may be simplified.

Further, when the plurality of pattern images are formed at different positions, the number of optical modules for forming a first pattern image may be different from the number of optical modules for forming a second pattern image. Thus, even when the positions of the plurality of pattern images are different from one another, the plurality of pattern images may have substantially uniform brightness.

Further, when the plurality of pattern images are formed at different positions, a size of the transmissive region of the shield for forming a first pattern image may be different from a size of the transmissive region of the shield for forming a second pattern image. Thus, even when the positions of the plurality of pattern images are different from one another, the images may have a substantially uniform size.

In addition to the effects as described above, specific effects in accordance with the present disclosure will be described together with the detailed description for carrying out the disclosure.

BRIEF DESCRIPTION OF DRAWINGS

The above and other aspects and features of the present disclosure will become more apparent by describing in detail exemplary embodiments thereof with reference to the attached drawings, in which.

DETAILED DESCRIPTIONS

Figure 1:
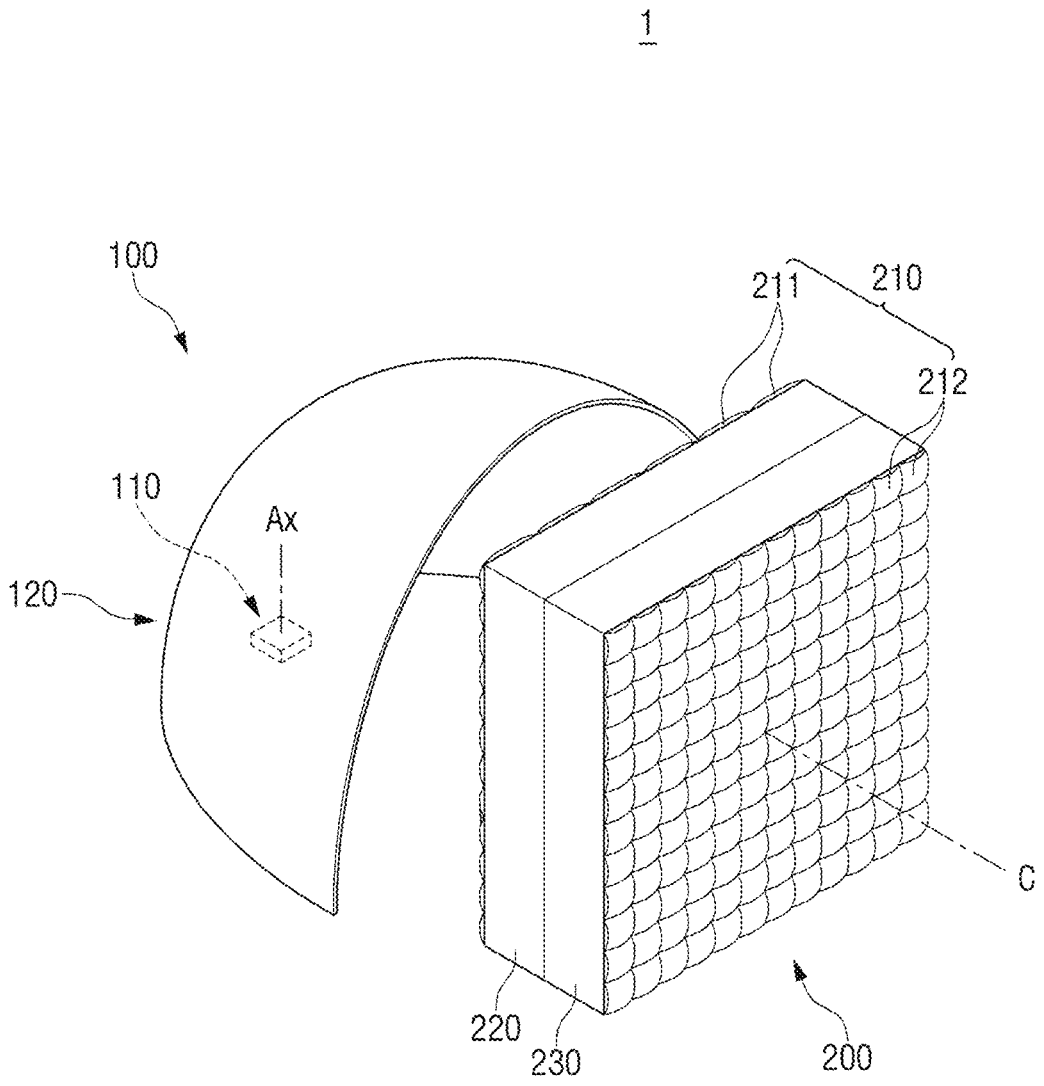
FIGS. 1 and 2 are perspective views showing a lamp for a vehicle according to an exemplary embodiment of the present disclosure.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements.

In some embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing a lamp for a vehicle based on implementations of the present disclosure.

Figure 2:
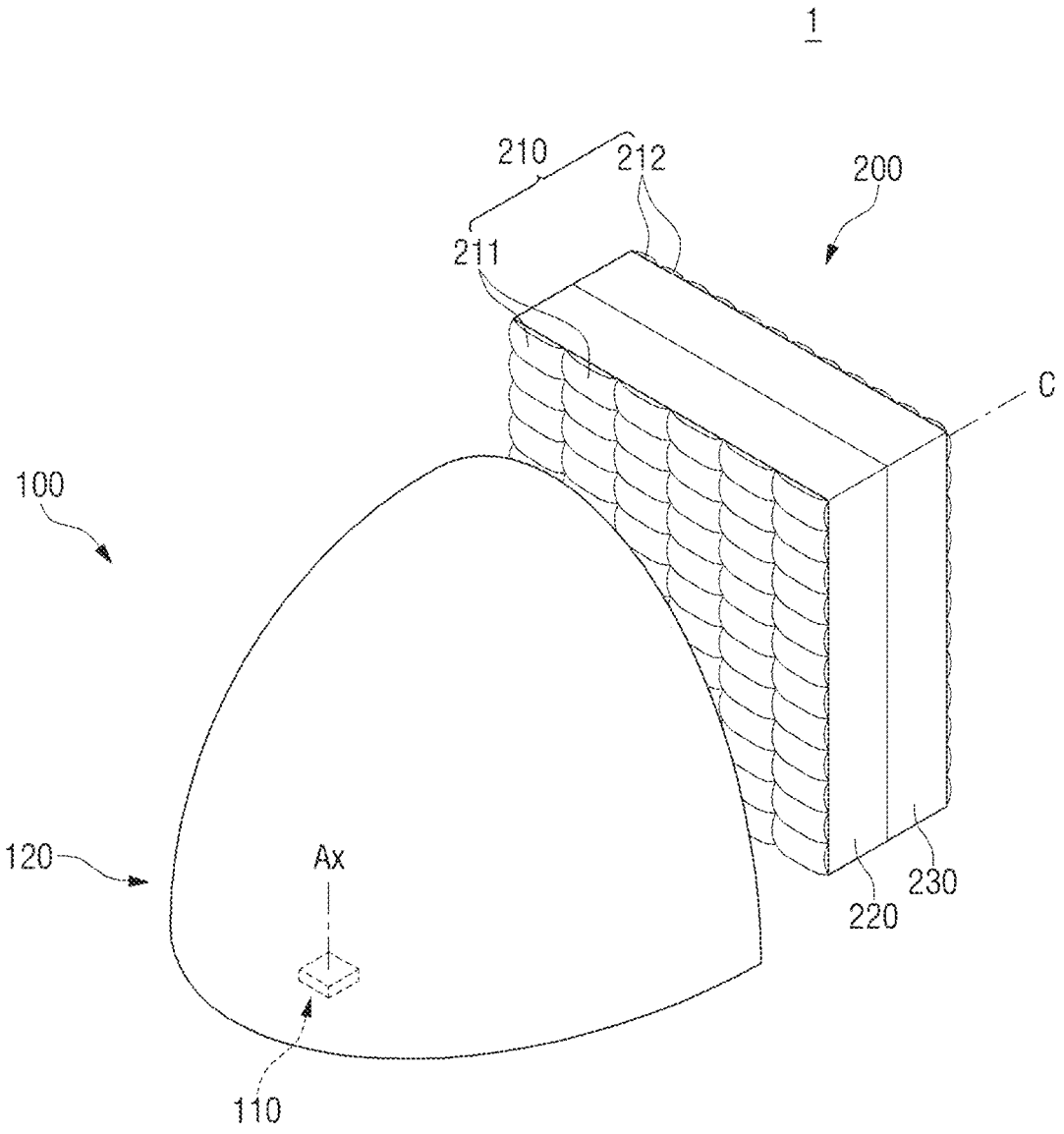
Figure 3:
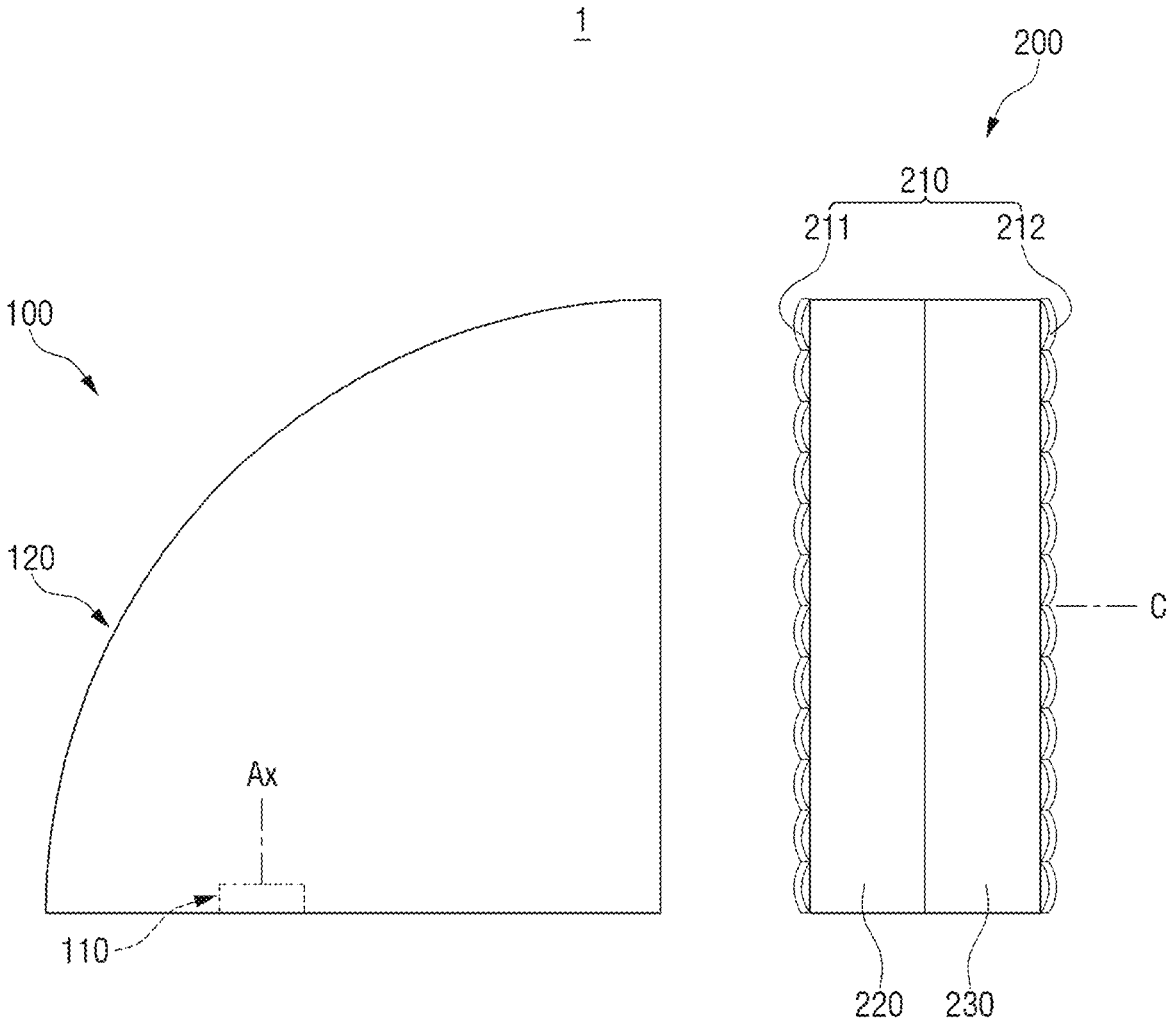
FIG. 3 is a side view showing a lamp for a vehicle according to an exemplary embodiment of the present disclosure.

FIGS. 1 and 2 are perspective views showing a lamp for a vehicle according to an implementation of the present disclosure, and FIG. 3 is a side view showing a lamp for a vehicle according to an implementation of the present disclosure. Referring to FIG. 1, a lamp 1 for a vehicle according to an implementation of the present disclosure may include a light emission system 100 and an optical system 200. The light emission system 100 and the optical system 200 may be housed in an interior space defined by a lamp housing (not shown) and a cover lens (not shown) that is coupled to the lamp housing to irradiate light to an outside of the vehicle.

In an implementation of the present disclosure, the lamp 1 for the vehicle may have a variety of functions including an illumination function such as a function of a head lamp that ensures a driver's field of view when driving the vehicle in low light conditions (e.g., at night), a signaling function such as a function of a position lamp, a daytime running lamp (DRL), a turn signal lamp, a brake lamp, etc. that informs another driver or a pedestrian of the driving state of the vehicle, and a function to display an image representing various information that drivers of nearby vehicles or pedestrians need to recognize on a road surface around the vehicle. The lamp 1 for the vehicle according to the present disclosure may have a single function among the above-described functions, or may have a combination of two or more functions thereof.

Hereinafter, in an implementation of the present disclosure, description will be provided for an example in which the lamp 1 for the vehicle according to the present disclosure has a function to form a light irradiation pattern including at least one pattern image having a predefined size on a road surface around the vehicle. However, the present disclosure is not limited thereto. The present disclosure may be applied to a case where the lamp 1 for the vehicle according to the present disclosure forms a light irradiation pattern for an illumination function or a signaling function.

The light emission system 100 may generate light with a color and/or brightness suitable for the function of the lamp 1 for the vehicle according to the present disclosure. Light emitted from the light emission system 100 may proceed to be incident on the optical system 200 disposed in front of the light emission system 100.

Further, when the lamp 1 for the vehicle according to the present disclosure irradiates a light irradiation pattern that includes at least one pattern image having a shape of a predefined size on a road surface around the vehicle, at least one of the light emission system 100 or the optical system 200 may be inclined with respect to a horizontal plane toward the road surface.

Figure 4:
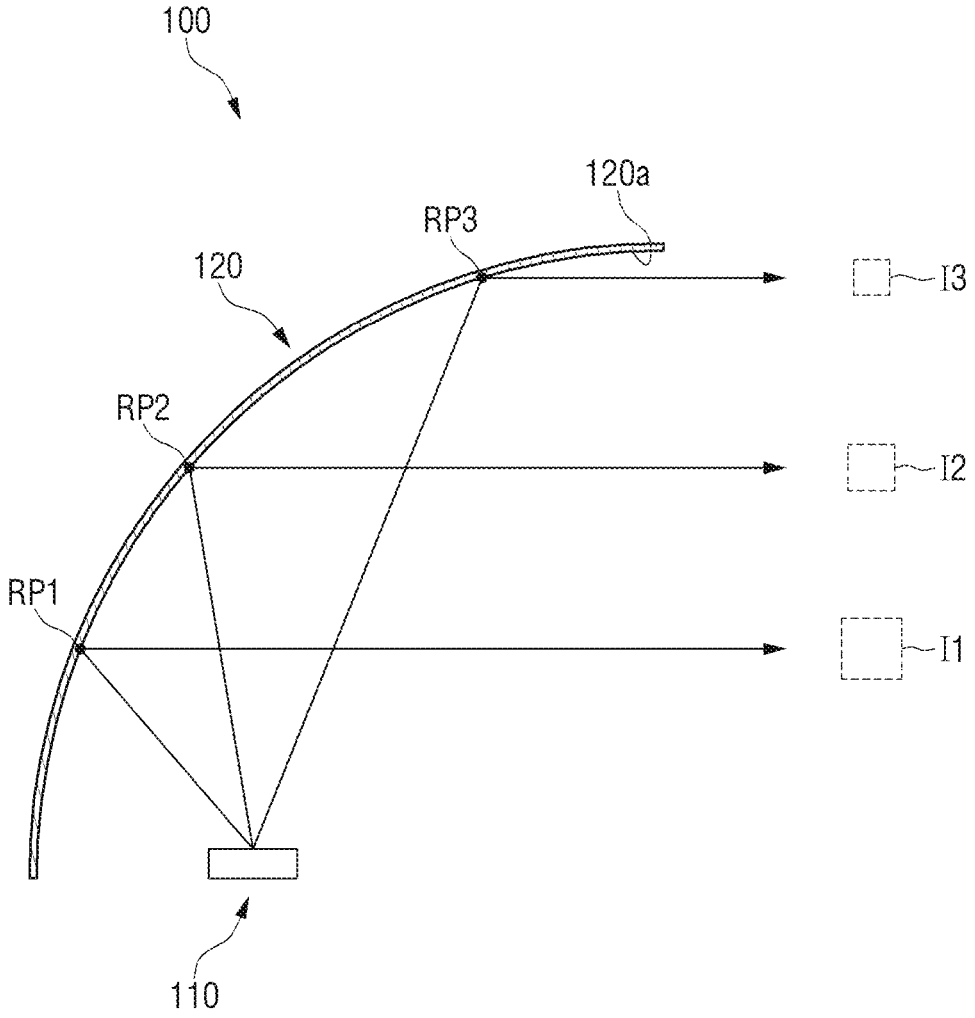
FIG. 4 is a schematic diagram showing a light emission system according to an exemplary embodiment of the present disclosure.

FIG. 4 is a schematic diagram showing the light emission system according to an implementation of the present disclosure. Referring to FIG. 4, the light emission system 100 according to an implementation of the present disclosure may include a light source 110 and an optical path controller 120. The light source 110 may include at least one light source that emits light having a color and/or brightness suitable for the function of the lamp 1 for the vehicle according to the present disclosure. In an implementation of the present disclosure, a case where a semiconductor light emission device such as a light emitting diode (LED) is used as the at least one light source will be described by way of example. However, the present disclosure is not limited thereto. The at least one light source may employ not only an LED, but also various types of light sources such as a bulb or a laser diode (LD). Optical elements such as mirrors, prisms, lenses, and reflectors that affect light properties such as brightness or a path of light may be additionally used depending on a type of light source.

The optical path controller 120 may adjust a light path to allow the light emitted from the light source 110 to travel substantially in parallel with an optical axis of the light source. In an implementation of the present disclosure, the optical path controller 120 may be embodied as a reflector that reflects the light emitted from the light source 110 to cause it to travel substantially in parallel with a center line C of the optical system 200, that is, a line passing through the center of the optical system 200 in the front and rear direction. However, the present disclosure is not limited thereto. The optical path controller 120 may employ not only a reflector, but also various types of collimator lenses such as aspherical lenses, Fresnel lenses, and total internal reflection (TIR) lenses.

In an implementation of the present disclosure, a configuration where the light source 110 includes a single light source, and the optical path controller 120 includes a single reflector is described by way of example. However, the present disclosure is not limited thereto. The number of light sources included in the light source 110 and the number of reflectors included in the optical path controller 120 may vary.

When the optical path controller 120 is embodied as the reflector, the light source 110 may be positioned to generate light upward or downward so that the light reflected by the optical path controller 120 may proceed to the optical system 200. The optical path controller 120 may be constructed such that a reflective face 120*a* thereof may exhibit a parabolic shape or a free curved shape based on a parabola, and may extend from a front end where the light is emitted from the light source 110 to a rear end that is disposed behind the light source 110. Accordingly, the light emitted from the light source 110 upward or downward may proceed forward.

In an implementation of the present disclosure, a case where the light is emitted from the light source 110 in an upward direction is described by way of example. In such a case, the optical path controller 120 may be formed to extend in a downward direction from the front end that is disposed above the light source 110 to a rear end that is disposed behind the light source 110.

As described above, when the light is emitted from the light source 110 in the upward direction, and the light is reflected from the optical path controller 120 and proceeds forward, an optical axis Ax of the light source 110 and the center line C of the optical system 200 may have different directions. However, the present disclosure is not limited thereto. Depending on the positions of the light source 110 and the optical path controller 120, the optical axis Ax of the light source 110 and the center line C of the optical system 200 may have the same direction.

Brightness of the light reflected from the optical path controller 120 to the optical system 200 may vary depending on a point where the light emitted from the light source 110 reaches on the optical path controller 120. In other words, the brightness may vary because distances between the light source 110 and the points of the reflective face 120*a* where the light emitted from the light source 110 reaches are different.

For example, a plurality of points RP1, RP2, and RP3 having different distances from the light source 110 may be arranged along the reflective faces 120*a* of the optical path controller 120. As the distances to the plurality of points RP1, RP2, and RP3 from the light source 110 increase, reflected images I1, I2, and I3 obtained by the light beams that are respectively reflected from the plurality of points RP1, RP2, and RP3 may become smaller, as shown in FIG. 4. Accordingly, the brightness of light beams respectively reflected from the plurality of points RP1, RP2, and RP3 may decrease as the distances between the plurality of points RP1, RP2, and RP3 and the light source 110 increase.

In other words, the brightness of the light reflected from a point of the reflective face 120*a* of the optical path controller 120 may increase as the distance between the point and the light source 110 decreases. The brightness of the light reflected from the point RP1, which is the closest to the light source 110 among the plurality of points RP1, RP2, and RP3, may be the maximum. The brightness of the light reflected from the point RP3, which is the farthest from the light source 110 among the plurality of points RP1, RP2, and RP3, may be the minimum.

Even when the brightness (per unit area) of the light beams that are respectively reflected from different points of the reflective face 120*a* of the optical path controller 120 are different from one another, the brightness of the pattern images that are respectively formed by the light beams having different brightness may be made more uniform by adjusting the area of the regions having the different brightness, which feature will be described later.

In an implementation of the present disclosure, the pattern images respectively formed by the light beams reflected from the plurality of points RP1, RP2, and RP3 may exhibit more uniform brightness by making the light reflected from the point RP3, which is disposed farthest from the light source 110, irradiate to the farthest position from the vehicle, and making the light reflected from the point RP1, which is disposed closest to the light source 110, irradiate to the nearest position to the vehicle. With such a configuration, interference between the light beams that are reflected from the plurality of points RP1, RP2, and RP3 may be suppressed as well. A detailed description thereof will be provided later.

The optical system 200 may be configured to allow the light beams incident thereto from the light emission system 100 to exit in different directions. Thus, the light irradiation pattern formed by the lamp 1 for the vehicle according to the present disclosure may include a plurality of pattern images.

Figure 5:
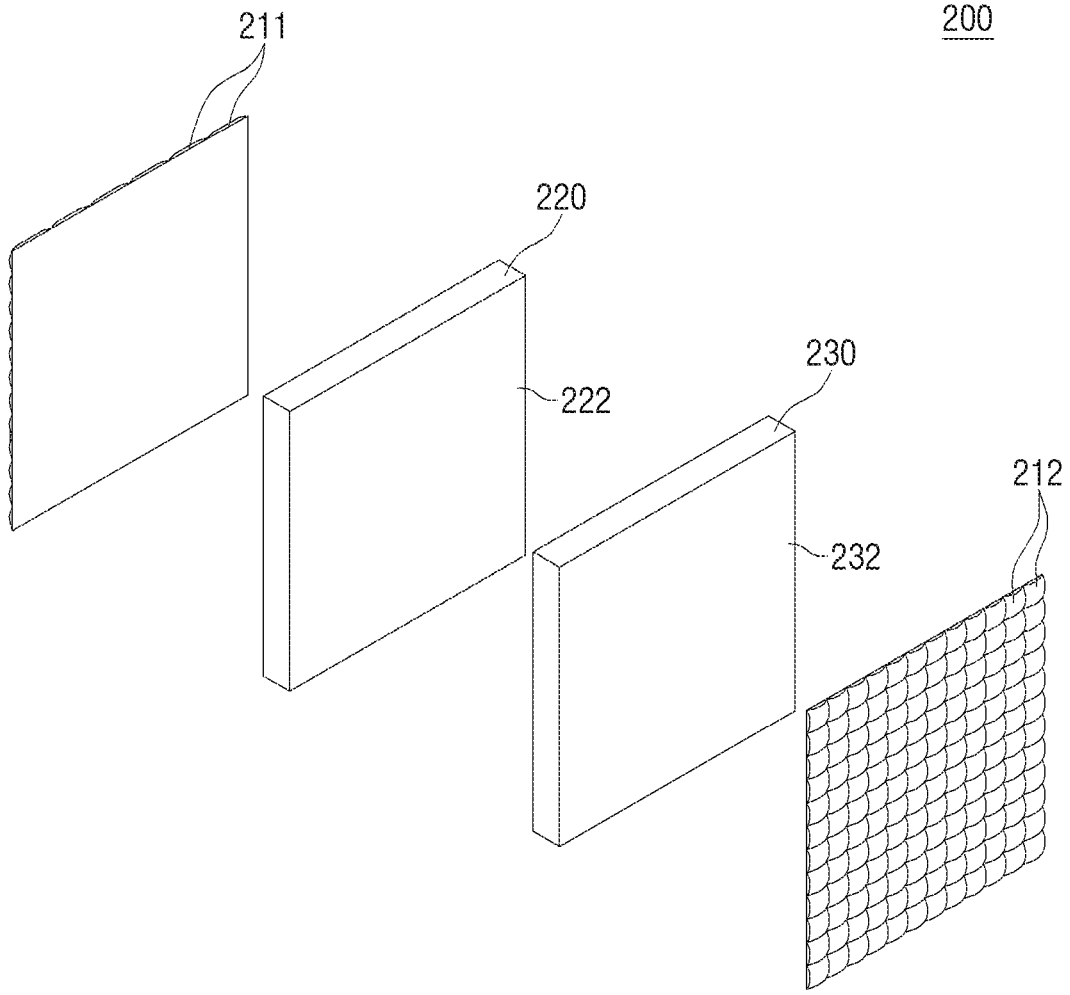
FIGS. 5 and 6 are exploded perspective views showing an optical system according to an exemplary embodiment of the present disclosure.
Figure 6:
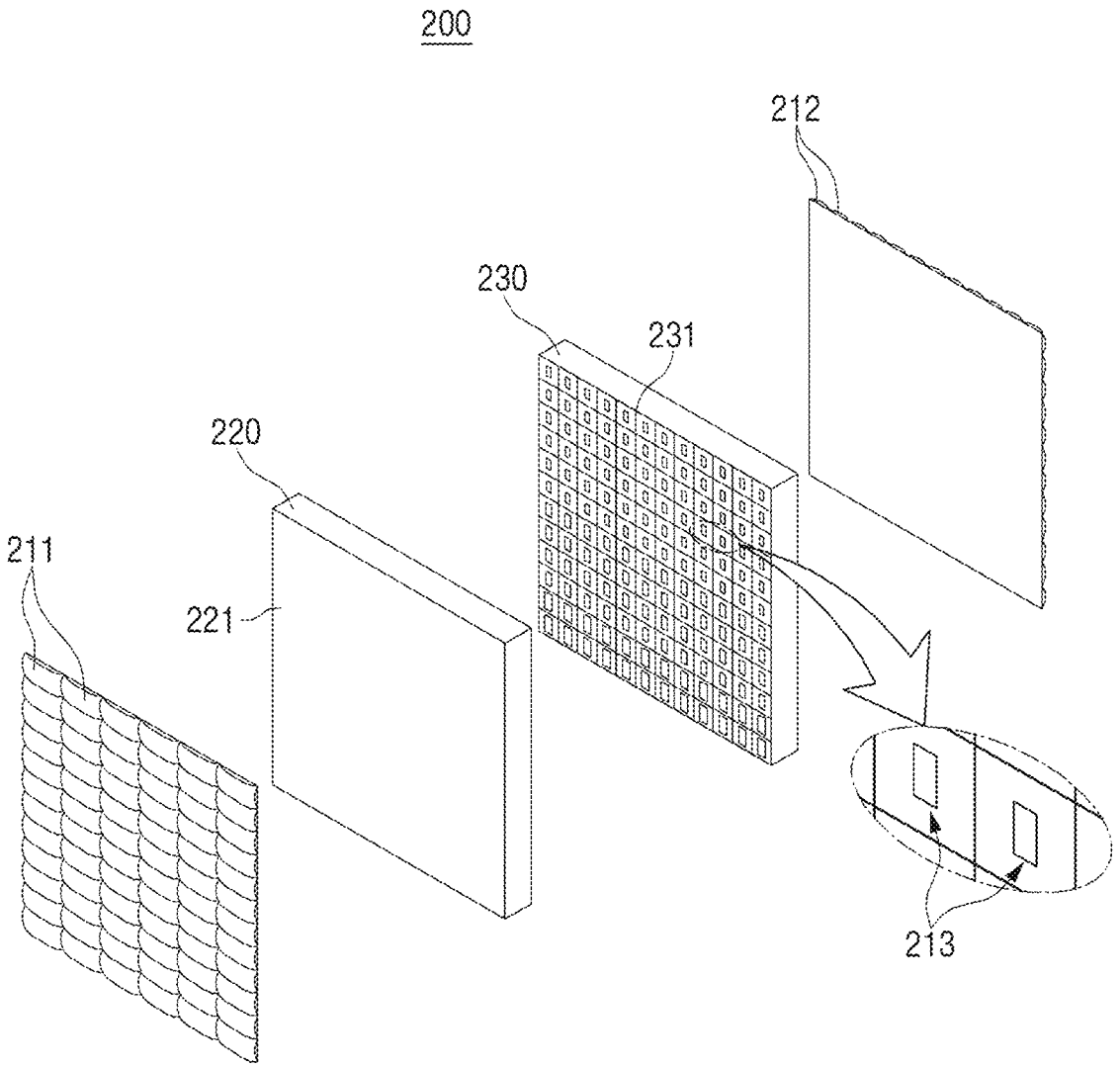
Figure 7:
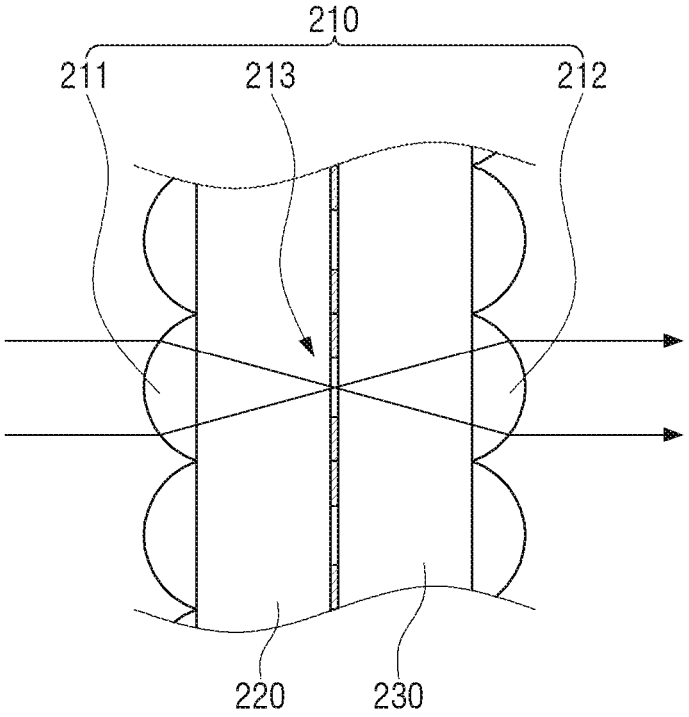
FIG. 7 is a schematic diagram showing a light path of an optical module according to an exemplary embodiment of the present disclosure.

FIGS. 5 and 6 are exploded perspective views showing the optical system according to an implementation of the present disclosure, and FIG. 7 is a schematic diagram showing a light path of an optical module according to an implementation of the present disclosure.

Referring to FIGS. 5-7, the optical system 200 according to an implementation of the present disclosure may include a plurality of incident lenses 211, a plurality of exit lenses 212, and a plurality of shields 213.

A light beam emitted from the light emission system 100 and incident toward an incident lens among the plurality of incident lenses 211 may proceed to an exit lens among the plurality of exit lenses 212 that corresponds to the incident lens and may exit from the corresponding exit lens. Each of the plurality of shields 213 may block (e.g., obstruct) at least a portion of a light beam that is directed to each of the plurality of exit lenses 212, based on a shape and/or a size of the light irradiation pattern formed by the lamp 1 for the vehicle according to the present disclosure.

Hereinafter, in an implementation of the present disclosure, a set of corresponding incident lenses 211, exit lenses 212, and shields 213 is referred to as an optical module 210. In this regard, the optical system 200 may be understood to include a plurality of optical modules 210 that are arranged in a matrix form.

The plurality of incident lenses 211 may be arranged on an incident surface 221 of a first optical member 220 that is made of a material through which light may transmit, such as glass. The plurality of exit lenses 212 may be arranged on an exit surface 232 of a second optical member 230 that is made of a material through which light may transmit, similar to the first optical member 220. The first optical member 220 and the second optical member 230 may be arranged in a front-rear direction so that the exit surface 222 of the first optical member 220 and the incident surface 231 of the second optical member 230 may face each other.

In an implementation of the present disclosure, a case in which the plurality of shields 213 are formed on an incident surface 231 of the second optical member 230 will be described by way of example. However, this is only an example to help understanding the present disclosure, and the present disclosure is not limited thereto. The plurality of shields 213 may be formed on at least one surface of one of the first optical member 220 or the second optical member 230, depending on a location of a focal point between the plurality of incident lenses 211 and the plurality of exit lenses 212 corresponding to the plurality of incident lenses 211.

Further, in an implementation of the present disclosure, a single shield may be disposed between the plurality of incident lenses 211 and the plurality of exit lenses 212 corresponding to the plurality of incident lenses 211. However, the present disclosure is not limited thereto. Based on the light irradiation pattern formed by the lamp 1 for the vehicle according to the present disclosure, two or more shields may be arranged in the front and rear direction and may be disposed between the plurality of incident lenses 211 and the plurality of exit lenses 212 corresponding to the plurality of incident lenses 211.

In an implementation of the present disclosure, each of the plurality of incident lenses 211 may include a semi-cylindrical shape that extends in the left and right direction, and the light exiting from one of the plurality of incident lenses 211 may be incident to multiple exit lenses that are arranged in the left and right direction among the plurality of exit lenses 212. However, the present disclosure is not limited thereto. Depending on a size, a shape, and brightness of the light irradiation pattern formed by the lamp 1 for the vehicle according to the present disclosure, the plurality of incident lenses 211 and the plurality of exit lenses 212 may correspond to each other in one-to-one, one-to-many, many-to-one, or many-to-many manners.

The optical system 200 as described above may be configured such that some of the plurality of optical modules 210 emit light beams in a direction different from the light beams emitted by some other of the plurality of optical modules 210, such that the light irradiation pattern formed by the lamp 1 for the vehicle according to the present disclosure may include a plurality of pattern images respectively formed at different positions. Thus, the light irradiation pattern formed by the lamp 1 for the vehicle according to the present disclosure may include the plurality of pattern images respectively formed at different positions.

Figure 8:
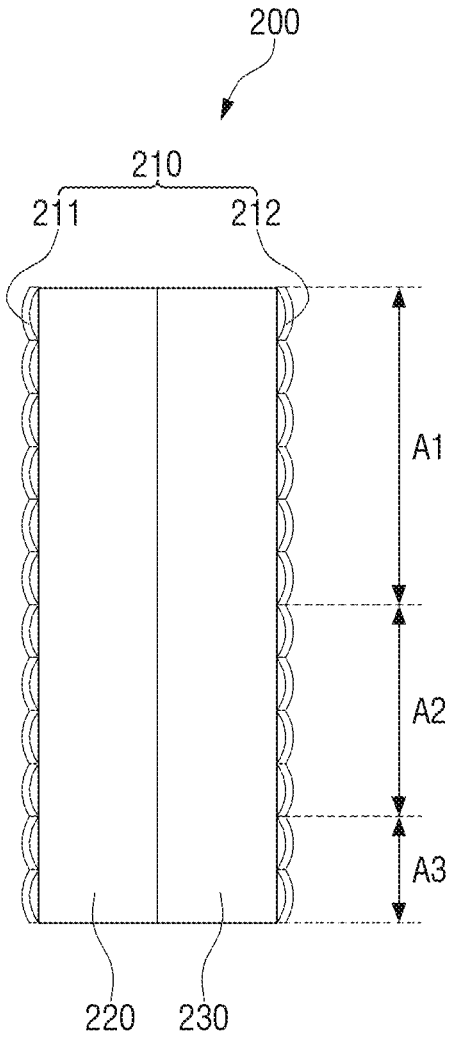
FIG. 8 is a schematic diagram showing a plurality of regions of an optical system according to an exemplary embodiment of the present disclosure.

FIG. 8 is a schematic diagram showing a plurality of regions of an optical system according to implementation of the present disclosure. Referring to FIG. 8, an entire region of the optical system 200 according to an implementation of the present disclosure may be divided into a plurality of regions A1, A2, and A3. Directions in which the light beams irradiate from the optical modules 210 respectively belonging to the plurality of regions A1, A2, and A3 may be different from one another.

Hereinafter, in an implementation of the present disclosure, the plurality of regions A1, A2, and A3 may include a first region A1 (an upper region), a second region A2 (a middle region), and a third region A3 (a lower region). In an implementation of the present disclosure, a case where the optical system 200 is divided into three regions A1, A2, and A3 is described by way of example. This is because the light irradiation pattern formed by the lamp 1 for the vehicle according to the present disclosure includes three pattern images. In general, depending on the number of pattern images included in the light irradiation pattern formed by the lamp 1 for the vehicle according to the present disclosure, the optical system 200 may be divided into two or more regions.

The first to third regions A1, A2, and A3 may have different sizes. In an implementation of the present disclosure, the size of the first region A1 that irradiates the light beam to the farthest point from the vehicle may be the largest, and the size of the third region A3 that irradiates the light beam to the nearest point to the vehicle may be the smallest. Due to this configuration, the pattern images respectively formed by the light beams that respectively exit from the first to third regions A1, A2, and A3 may have more uniform brightness.

In other words, the first region A1 among the first to third regions A1, A2, and A3 may have the largest size because, as shown in FIG. 4, the light emitted from the light emission system 100 and incident to the first region A1 has relatively low brightness, and the light exiting from the first region A1 is irradiated to the farthest point from the vehicle. The sizes of the first to third regions A1, A2, and A3 are not limited to the examples described above, and the size of the first to third regions A1, A2, and A3 may vary depending on the brightness of the light beams incident to the first to third regions A1, A2, and A3 and the locations to which the light beams from the first to third regions A1, A2, and A3 are irradiated.

Further, in an implementation of the present disclosure, a case where the first region A1 that is the largest region among the first to third regions A1, A2, and A3 is an upper region, while the third region A3 that has the smallest size is a lower region is described by way of example. However, the present disclosure is not limited thereto. The location of the largest region among the first to third region A1, A2, and A3 may vary as long as one of the first to third regions A1, A2, and A3 that irradiates a light beam to the farthest point from the vehicle has the largest size. In other words, a region among the plurality of regions, which irradiates a light beam to a point farther from the vehicle than any other regions, may be formed larger than any other regions.

The directions in which light beams are emitted from the first to third regions A1, A2, and A3 may vary depending on a curvature or a position of each of the incident lens 211 and the exit lens 212 of each optical module 210 that corresponds to the regions A1, A2, and A3 among the plurality of optical modules 210, or may vary based on a location of the shield 213.

Figure 9:
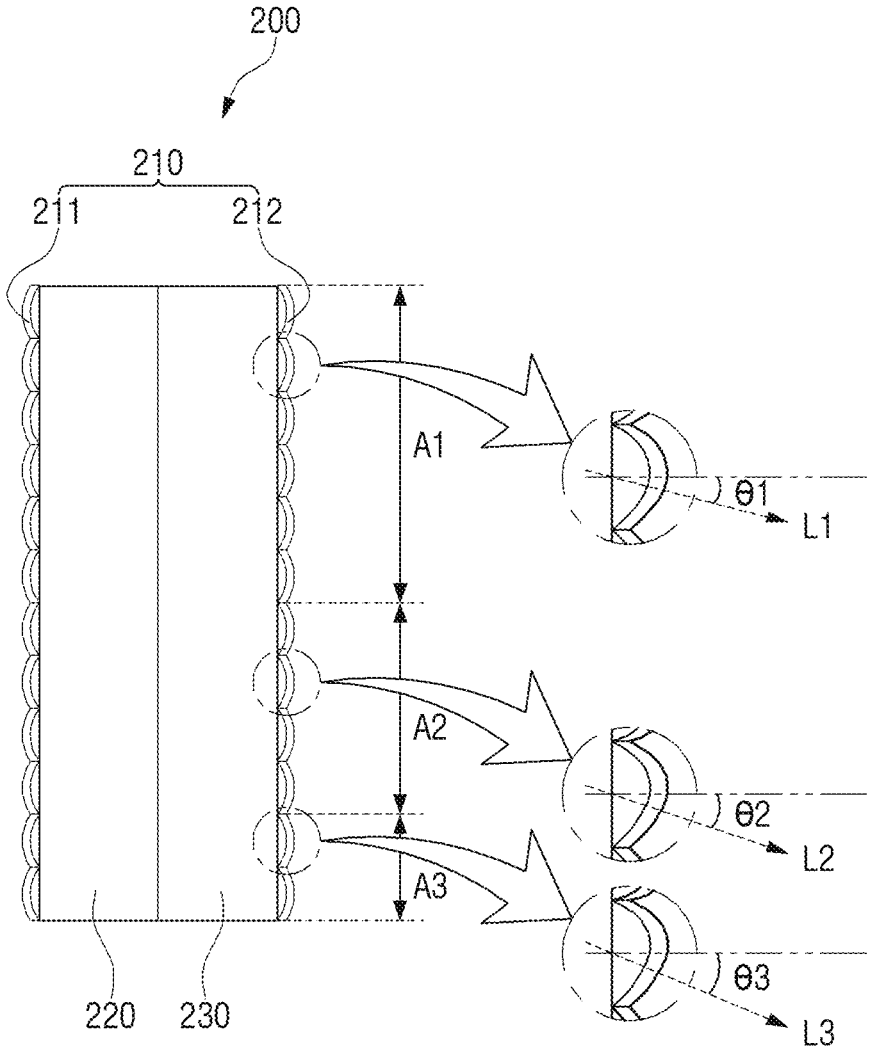
FIG. 9 is a schematic diagram showing a light output direction from each of a plurality of regions of an optical system according to an exemplary embodiment of the present disclosure.
Figure 10:
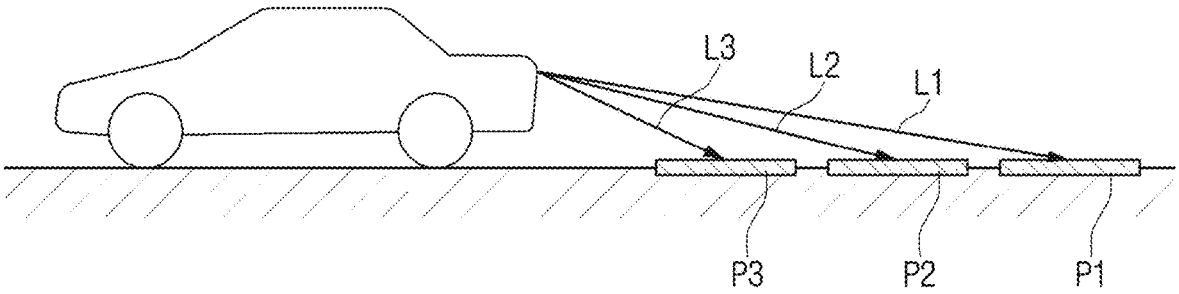
FIG. 10 is a schematic diagram showing a light irradiation pattern formed by a lamp for the vehicle according to an exemplary embodiment of the present disclosure.

For example, when the lamp 1 for the vehicle according to the present disclosure forms the light irradiation pattern on the road surface around the vehicle, the direction in which light exits from each of the first to third regions A1, A2, and A3 may be tilted at a predefined angle relative to the road surface, that is, the horizontal direction. In this case, as shown in FIG. 9, the emitting directions of the light beams L1, L2, and L3 from the first to third regions A1, A2, and A3 may be respectively referred to as angles θ1, θ2, and θ3, which are measured with respect to the horizontal direction. Thus, curvatures of the exit surfaces of the exit lenses 212 may be configured such that θ1 is smaller than θ2, and θ2 is smaller than θ3. Consequently, as shown in FIG. 10, the locations on the road surface to which the light beams L1, L2, and L3 respectively emitted from the first to third regions A1, A2, and A3 are irradiated may be different from one another. Thus, the light irradiation pattern that is formed by the lamp 1 for the vehicle according to the present disclosure may include a plurality of pattern images P1, P2, and P3 formed at different locations.

In this connection, the angle θ at which the direction of the light emitting from each of the plurality of optical modules 210 is tilted with respect to the horizontal direction may be calculated based on a distance d from the vehicle to each pattern image, and a vertical level h from the road surface at which the lamp 1 for the vehicle according to the present disclosure is installed, and using an Equation, $\theta=\tan^{-1}(h/d)$.

In an implementation of the present disclosure, a case where the direction of the light beam from each region is determined by adjusting the curvature of the exit surface of each of the plurality of exit lenses 212 is described by way of example. However, the present disclosure is not limited thereto. Adjusting an inclination of each portion of the exit surface 232 of the second optical member 230 on which the plurality of exit lenses 212 are formed may allow the direction of the light beam from each of the plurality of exit lenses 212 to be tilted at a predefined angle with respect to the horizontal direction.

Further, in an implementation of the present disclosure, a case in which the plurality of pattern images P1, P2, and P3 have the same shape and size is described by way of example. However, the present disclosure is not limited thereto. Varying the shape and/or the size of a region through which the light transmits using a shield for forming each pattern image may allow one of the plurality of pattern images P1, P2, and P3 to have a shape and/or a size different from another of the plurality of pattern images P1, P2, and P3.

Figure 11:
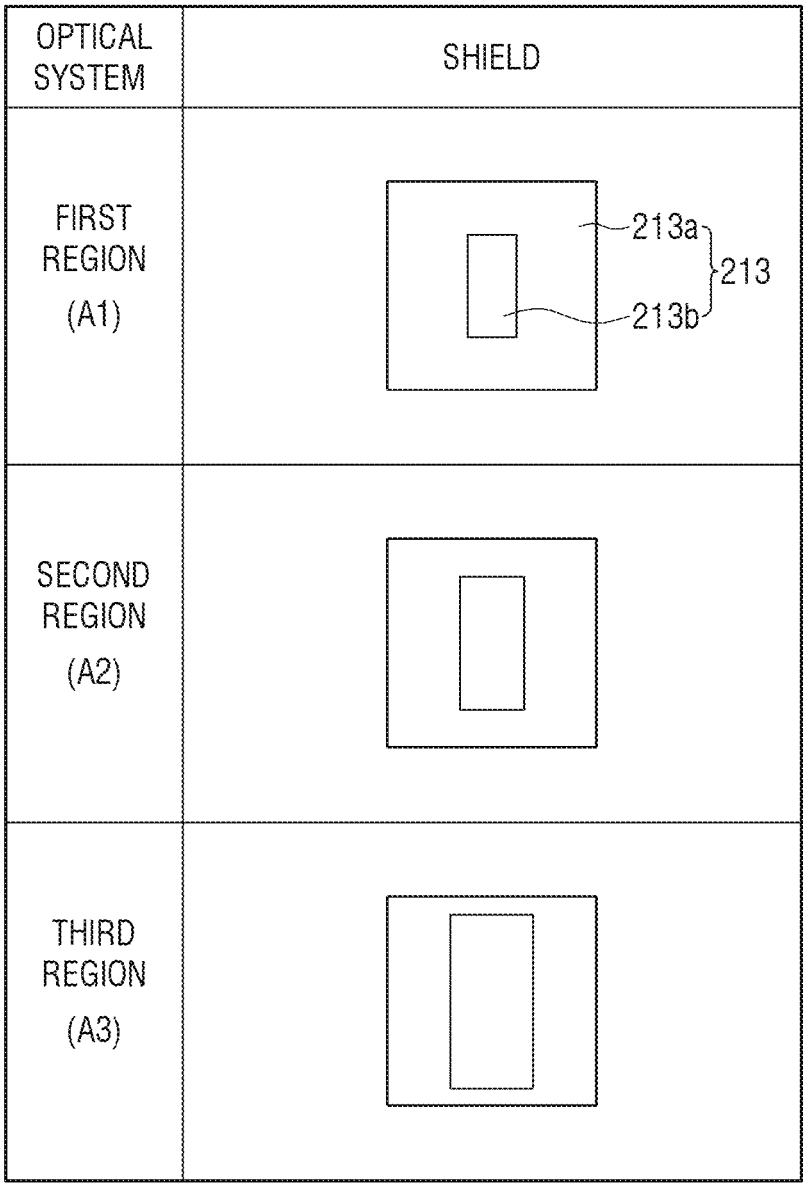
FIG. 11 is a schematic diagram showing a shield of each of a plurality of regions of an optical system according to an exemplary embodiment of the present disclosure.

As shown in FIG. 11, each of the plurality of shields 213 may include a blocking region 213*a* that blocks light and a transmissive region 213*b* that transmits light therethrough. A shape and/or a size of the pattern image may be varied depending on a shape and/or a size of the transmissive region 213*b*.

In this connection, when the size of the transmissive region 213*b* is constant, a size of a pattern image formed farther from the vehicle may become larger than a size of a pattern image formed nearer to the vehicle, due to the diffusion of light. For this reason, in an implementation of the present disclosure, the sizes of the transmissive regions 213*b* of the shields 213 corresponding to the first to third regions A1, A2, and A3 may be implemented to be different from one another. Thus, the plurality of pattern images may have the same size even when the positions of the pattern images are different.

FIG. 11 shows an example in which the size of the transmissive region 213*b* is the smallest for the first region A1 because the light exiting from the first region A1 is irradiated to the farthest distance from the vehicle. However, the present disclosure is not limited thereto. The shape and/or the size of the transmissive region of the shield of the optical module belonging to each of the first to third regions A1, A2, and A3 among the plurality of optical modules 210 may be varied based on the position on the road face where the pattern image is formed by the light beam exiting from each of the first to third regions A1, A2, and A3.

In one example, in the above implementation, a case in which a single light source is used as the light source 110, and a single reflector is used as the optical path controller 120 is described by way of example. However, the present disclosure is not limited thereto. The number of light sources and the number of reflectors may be varied depending on the number of pattern images included in the light irradiation pattern formed by the lamp 1 for the vehicle according to the present disclosure.

Figure 12:
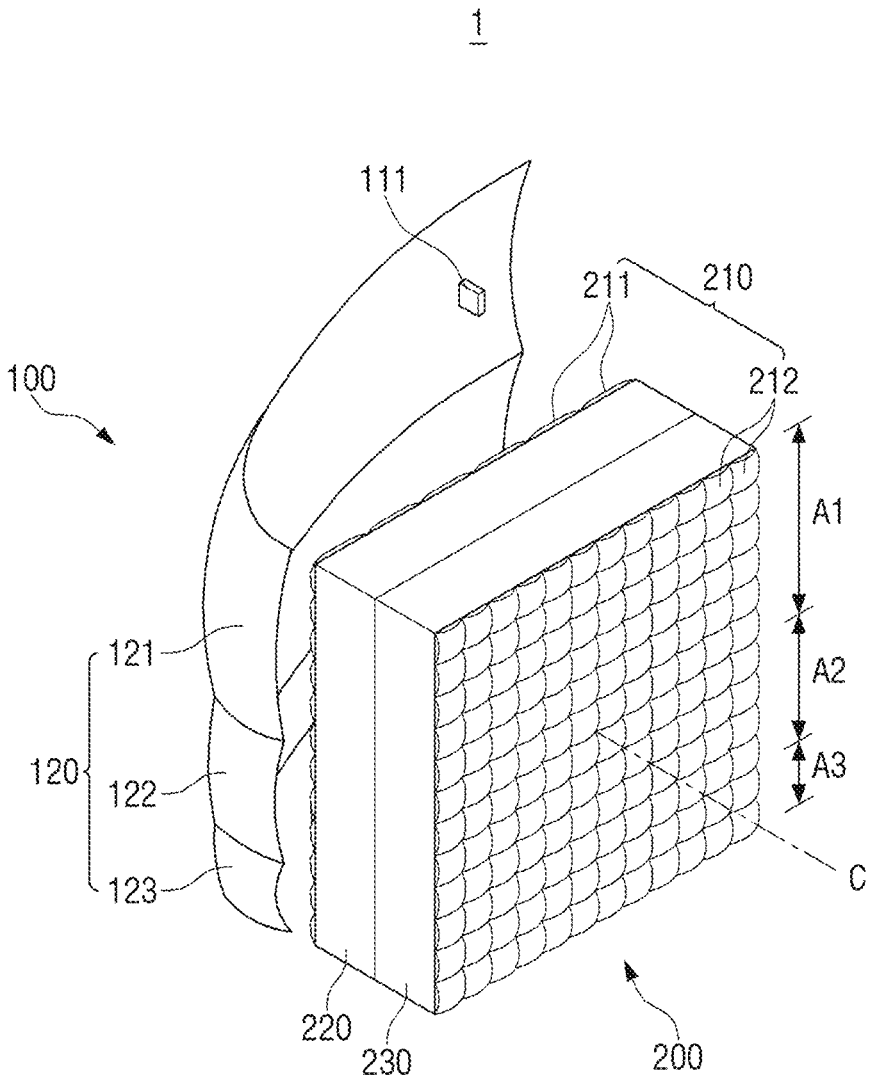
FIGS. 12 and 13 are perspective views showing a lamp for a vehicle according to another exemplary embodiment of the present disclosure.
Figure 13:
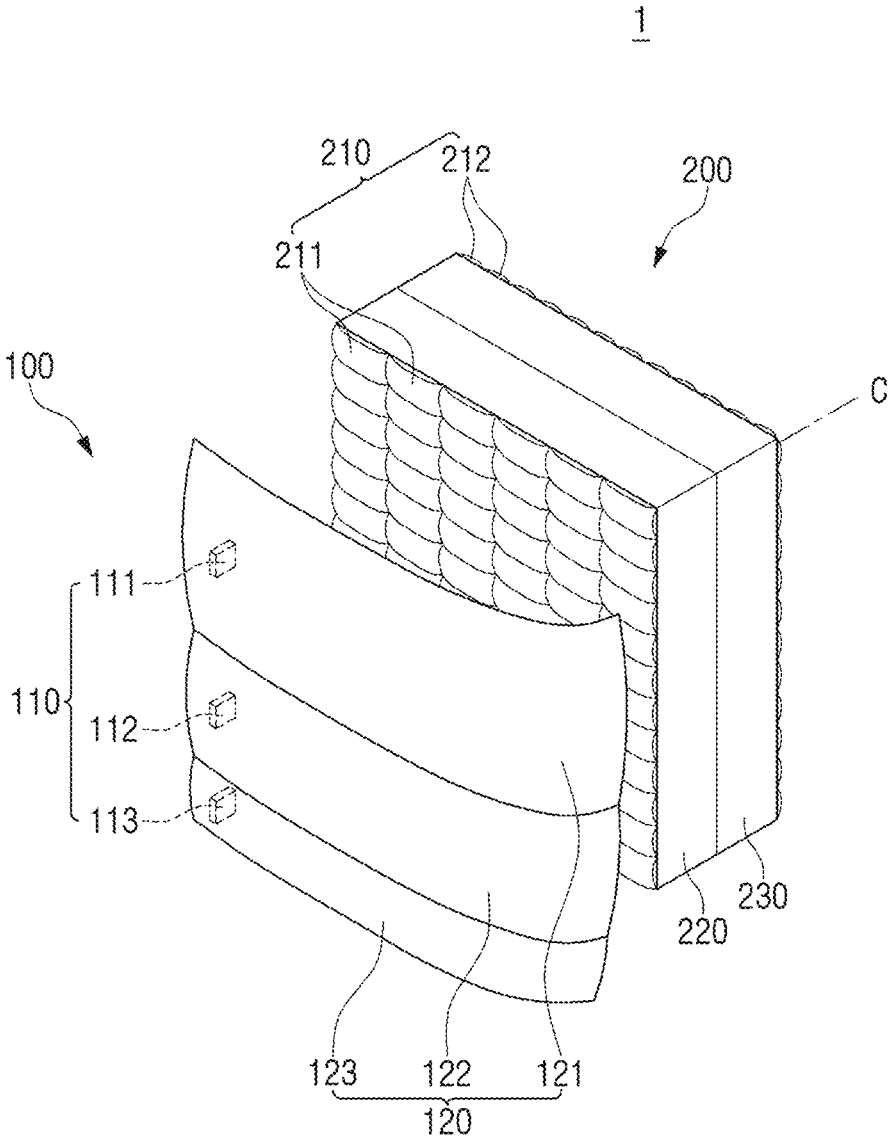
Figure 14:
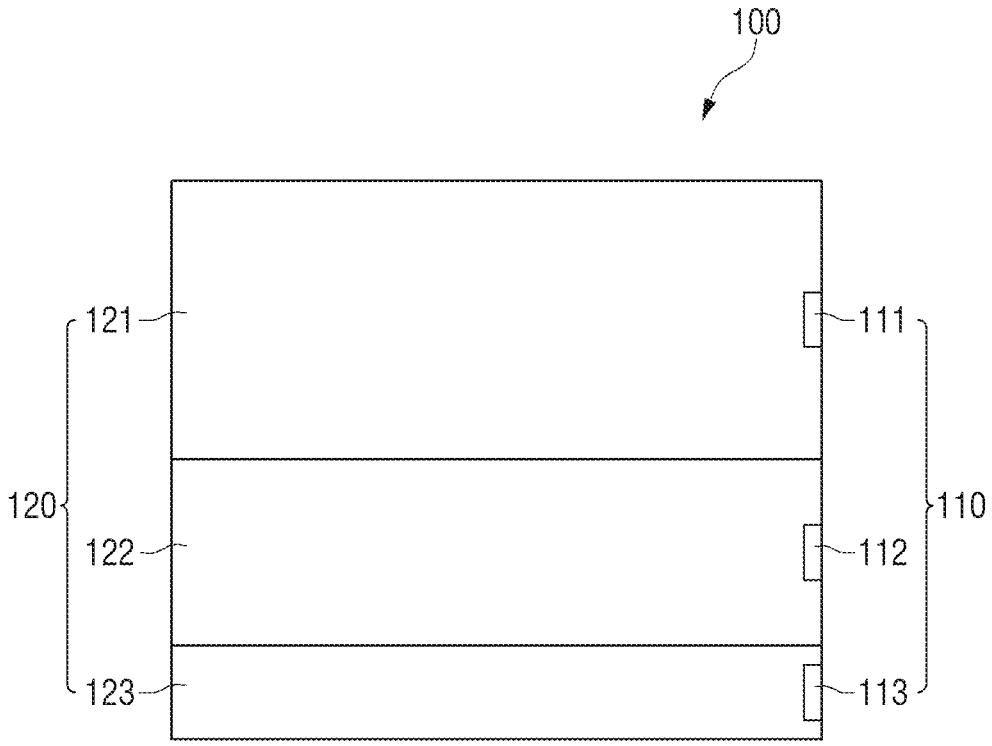
FIG. 14 is a front view showing a light emission system according to another exemplary embodiment of the present disclosure.

FIGS. 12 and 13 are perspective views showing a lamp for a vehicle according to another implementation of the present disclosure, and FIG. 14 is a front view showing a light emission system according to another implementation of the present disclosure. Referring to FIGS. 12-14, the lamp 1 for a vehicle according to another implementation of the present disclosure may include the light emission system 100 and the optical system 200 in a similar manner as the foregoing implementation. In another implementations of the present disclosure, components with similar functions as those in the above implementation will have the same reference numerals. A detailed description thereof will be omitted.

In another implementation of the present disclosure, the light emission system 100 may include the light source 110 and the optical path controller 120. The light source 110 may include a plurality of light sources 111, 112, and 113. The optical path controller 120 may include a plurality of reflectors 121, 122, and 123 corresponding to the plurality of light sources 111, 112, and 113, respectively.

The number of the plurality of light sources 111, 112, and 113 may be three, and the number of the plurality of reflectors 121, 122, and 123 may be three as well. This configuration may divide the optical system 200 into the three regions A1, A2, and A3 from which the light beams are emitted in different directions. Therefore, the number of the light sources and the number of the reflectors may be varied based on the number of regions A1, A2, and A3 of the optical system 200.

In another implementation of the present disclosure, a case in which, in a similar manner as the foregoing implementation, the plurality of regions A1, A2, and A3 are arranged downwardly in this order, and the sizes of the plurality of regions A1, A2, and A3 decrease in this order is described by way of example.

The plurality of light sources 111, 112, and 113 may be arranged in a direction in which the plurality of regions A1, A2, and A3 of the optical system 200 corresponding thereto are arranged. The plurality of light sources 111, 112, and 113 may be disposed on one side of the optical system 200 so that each light beam emitted from each of the plurality of light sources 111, 112, and 113 may be reflected from each of the plurality of reflectors 121, 122, and 123 and may proceed toward the optical system 200. Each of the plurality of light sources 111, 112, and 113 may emit the light in the left and right direction.

Each of the plurality of reflectors 121, 122, and 123 may be formed to have a size corresponding to a size of each of the plurality of regions A1, A2, and A3 of the optical system 200. In another implementation of the present disclosure, a case where the sizes of the plurality of regions A1, A2, and A3 decrease in this order is described by way of example. Correspondingly, the sizes of the plurality of reflectors 121, 122, and 123 may decrease in this order.

The configuration that the sizes of the plurality of reflectors 121, 122, and 123 decrease in this order is only an example to help understanding the present disclosure, and the present disclosure is not limited thereto. The size of each of the plurality of regions A1, A2, and A3, and thus, the size of each of the plurality of reflectors 121, 122, and 123 may be varied, based on a location on the road surface to which the light beam from each of the plurality of regions A1, A2, and A3 of the optical system 200 is irradiated, that is, a distance between a point to which the light is irradiated and the vehicle.

When the light emission system 100 includes the plurality of light sources 111, 112, and 113 and the plurality of reflectors 121, 122, and 123, the plurality of light sources 111, 112, and 113 may be turned on or off at the same time, or may be turned on or off sequentially. More specifically, when the plurality of light sources 111, 112, and 113 are turned on or off sequentially, the plurality of pattern images P1, P2, and P3 included in the light irradiation pattern of FIG. 10 may be turned on or off sequentially in a predefined order, thereby forming various light irradiation patterns.

In another implementation of the present disclosure, a case where the optical path controller 120 includes a plurality of reflectors 121, 122, and 123 is described by way of example. However, the present disclosure is not limited thereto. As in the foregoing implementation, the optical path controller 120 may employ various types of collimator lenses such as aspherical lenses, Fresnel lenses, and TIR lenses, or a combination thereof.

In another implementation of the present disclosure, a case where the sizes of the plurality of the regions A1, A2, and A3 decrease in this order is described by way of example. However, the present disclosure is not limited thereto. The sizes of the plurality of the regions A1, A2, and A3 may increase in this order.

Figure 15:
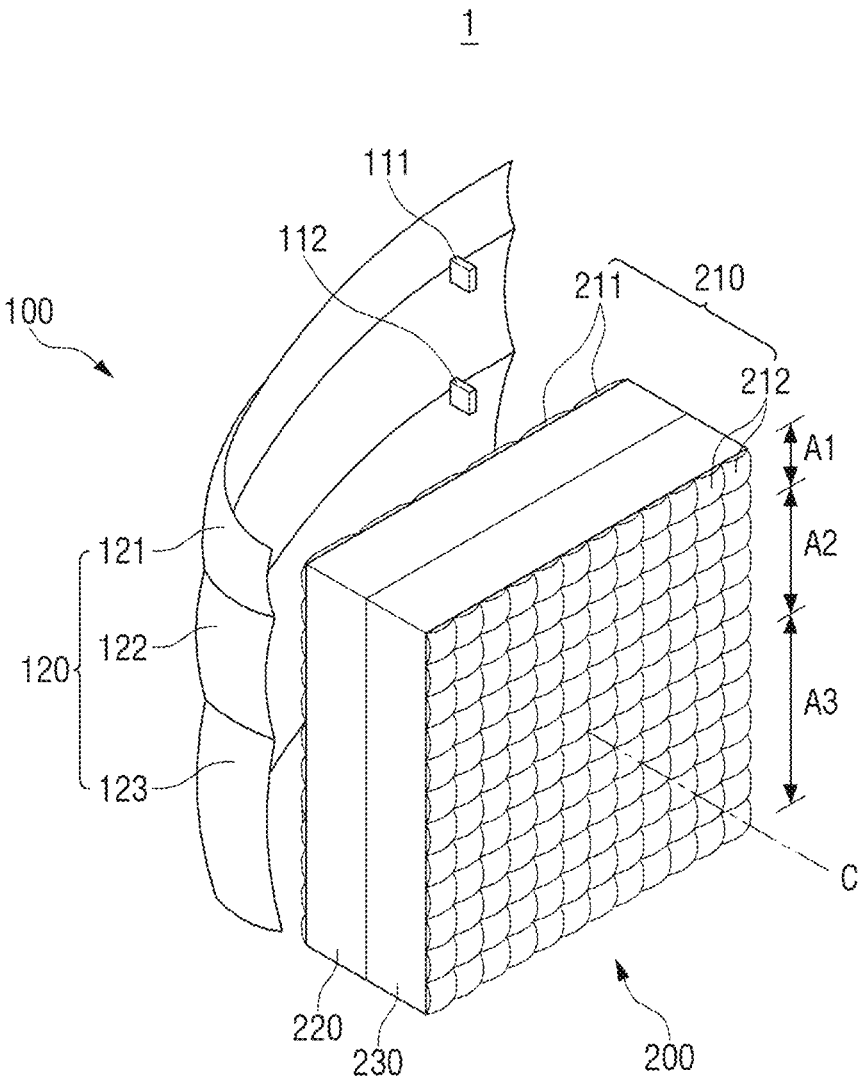
FIGS. 15 and 16 are perspective views showing a lamp for a vehicle according to another exemplary embodiment of the present disclosure.
Figure 16:
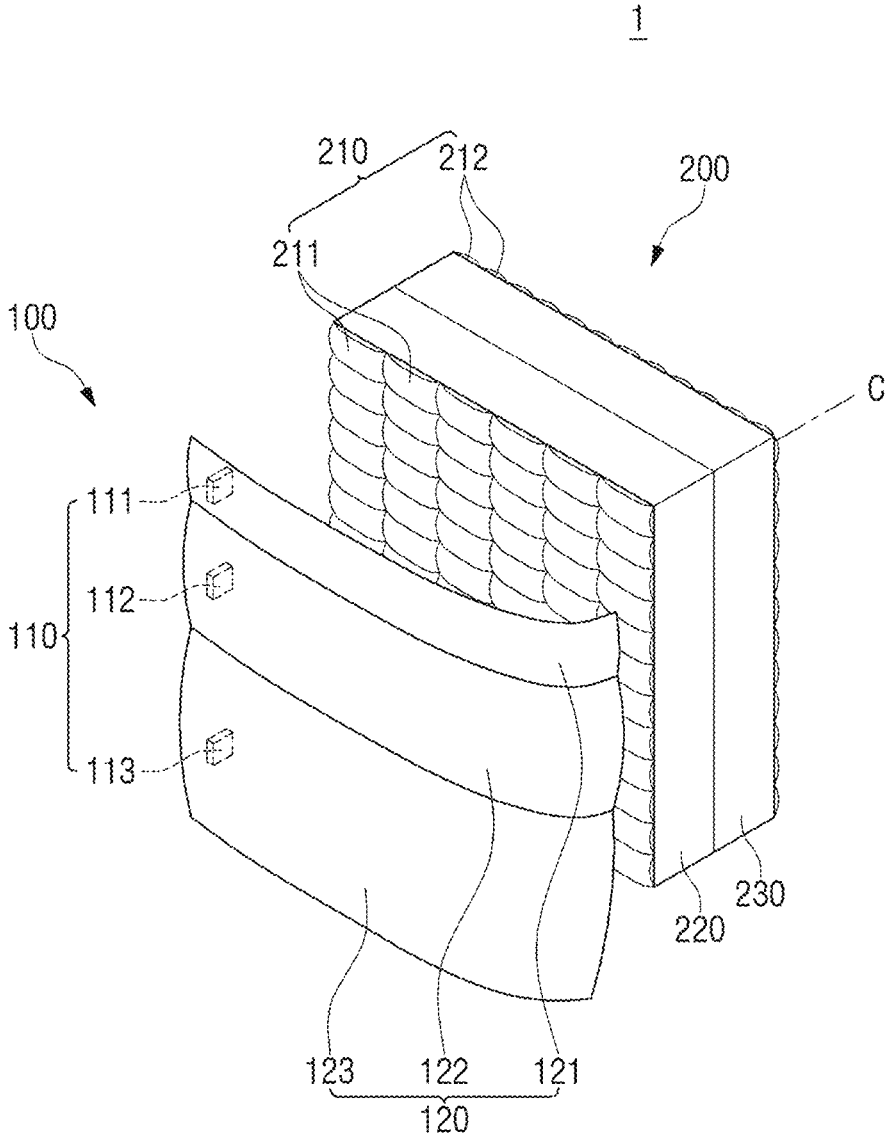
Figure 17:
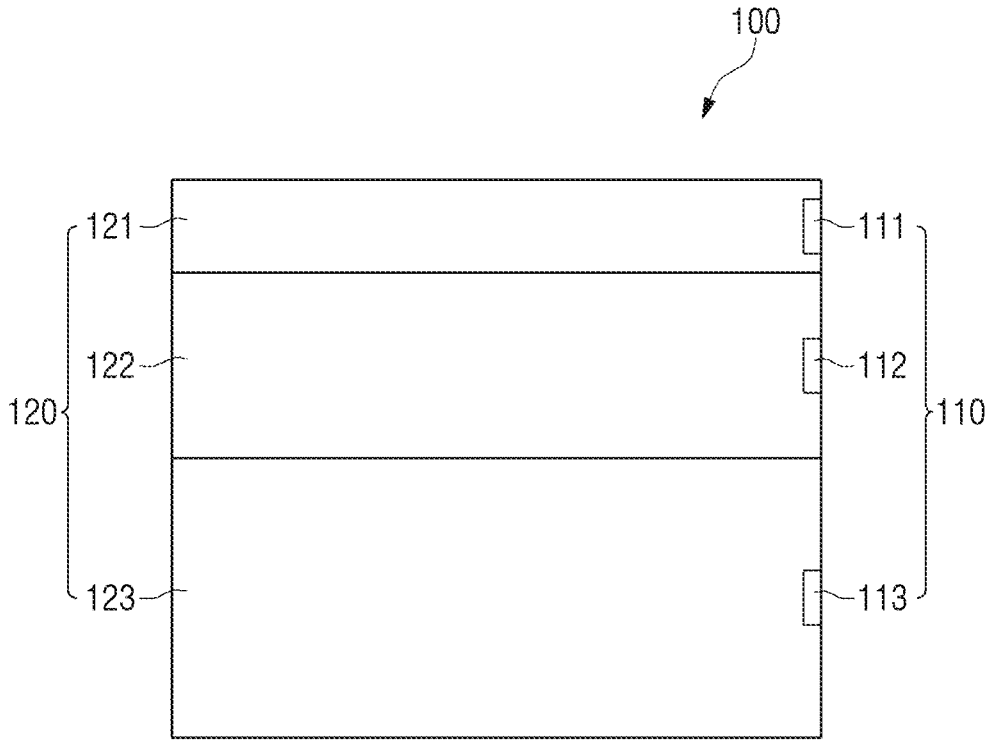
FIG. 17 is a front view showing a light emission system according to another exemplary embodiment of the present disclosure.

FIGS. 15 and 16 are perspective views showing a lamp for a vehicle according to still another implementation of the present disclosure. FIG. 17 is a front view showing a light emission system according to still another implementation of the present disclosure. Referring to FIGS. 15-17, the lamp 1 for a vehicle according to still another implementation of the present disclosure may include the light emission system 100 and the optical system 200 in a similar manner as the above implementations. Components with similar functions as those in the above implementations will have the same reference numerals. A detailed description thereof will be omitted.

In this implementation of the present disclosure, the optical system 200 may be divided into the plurality of regions A1, A2, and A3 arranged in a vertical direction, as in the above implementations. The light emission system 100 may include the plurality of light sources 111, 112, and 113 and the plurality of reflectors 121, 122, and 123 corresponding to the plurality of regions A1, A2, and A3.

In particular, in this implementation of the present disclosure, the plurality of regions A1, A2, and A3 of the optical system 200 may include an upper region A1, a middle region A2, and a lower region A3. In this case, a size of the upper region A1 may be smaller than that of the middle region A2, which is smaller than that of the lower region A3. As such, the sizes of the plurality of regions A1, A2, and A3 of the optical system 200 may increase in this order, in a contrary manner to the aforementioned FIGS. 12-14. Accordingly, the sizes of the plurality of reflectors 121, 122, and 123 may increase in this order as well. In this case, the light exiting from the lowest region A3 among the plurality of regions A1, A2, and A3 may be irradiated to a point disposed at the farthest distance from the vehicle, while the light exiting from the uppermost region A1 may be irradiated to a point disposed at the nearest distance to the vehicle.

In FIGS. 12-17 as described above, a case where the sizes of the plurality of regions A1, A2, and A3 increase or decrease in order is described. However, this is only an example to help understanding the present disclosure. The present disclosure is not limited thereto. The size of each of the plurality of regions A1, A2, and A3 may be varied as long as a region among the plurality of regions A1, A2, and A3 from which the light exits and then is irradiated to a point disposed at the farthest distance from the vehicle may be formed larger than the remaining two regions.

In FIGS. 12-17, description is provided for an example in which the sizes of the plurality of reflectors 121, 122, and 123 are different from one another, based on the different sizes of the plurality of regions A1, A2, and A3 of the optical system 200, and thus the pattern images P1, P2, and P3 respectively formed by the light beams irradiating respectively from the plurality of regions A1, A2, and A3 of the optical system 200 have substantially uniform brightness. However, the present disclosure is not limited thereto. Even when the plurality of regions A1, A2, and A3 of the optical system 200 have the same size and thus the plurality of reflectors 121, 123, and 123 have the same size, light beams from the plurality of light sources 111, 112, and 113 corresponding to the plurality of reflectors 121, 122, and 123 may have different brightness, such that the pattern images P1, P2, and P3 respectively formed by the light beams respectively exiting from the plurality of regions A1, A2, and A3 may have substantially uniform brightness.

As described above, using the lamp 1 for the vehicle according to the present disclosure, the plurality of pattern images P1, P2, and P3 may be formed at different distances from the vehicle without requiring a separate optical system for forming each of the plurality of pattern images P1, P2, and P3. Thus, the configuration of the lamp may be simplified, and the cost for manufacturing the lamp may be reduced.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A lamp for a vehicle, comprising:

a light emission system; and an optical system disposed in front of the light emission system, wherein the optical system is configured to allow light incident thereto from the light emission system to exit through a plurality of optical modules to form a predefined light irradiation pattern, wherein each of the plurality of optical modules includes an incident lens and an exit lens, wherein the light emission system includes:

a plurality of light sources; and a plurality of reflectors configured to allow a plurality of light beams respectively emitted from the plurality of light sources to be respectively directed to a plurality of regions of the optical system, wherein the optical system is configured to irradiate the plurality of light beams, which are respectively reflected from corresponding reflectors among the plurality of reflectors, to form the predefined light irradiation pattern on a road surface, and wherein the predefined light irradiation pattern includes a plurality of pattern images irradiated on the road surface, the plurality of pattern images having different distances from the vehicle.

2. The lamp of claim 1, wherein the plurality of reflectors respectively reflect the plurality of light beams emitted from the plurality of light sources to cause them to travel substantially in parallel with a line that passes through a center of the optical system in a front and rear direction.

3. The lamp of claim 1, wherein the plurality of reflectors have different sizes.

4. The lamp of claim 1, wherein the plurality of regions have different sizes, and each of the plurality of reflectors has a same size as a corresponding region among the plurality of regions.

5. The lamp of claim 1, wherein the plurality of regions have different sizes, which vary based on distances between the vehicle and points to which the plurality of light beams from the plurality of regions are irradiated.

6. The lamp of claim 1, wherein the plurality of regions are arranged in a vertical direction, and wherein a region among the plurality of regions, which irradiates a light beam to a point disposed farther from the vehicle than any other regions, is formed larger than any other regions.

7. The lamp of claim 6, wherein the region corresponds to an uppermost region or a lowermost region among the plurality of regions.

8. The lamp of claim 1, wherein directions of light beams that are irradiated from different optical modules belonging to different regions of the optical system have different tilt angles with respect to a horizontal direction.

9. The lamp of claim 8, wherein a light beam among the plurality of light beams, which is irradiated to a point disposed farther from the vehicle than any other light beams, is irradiated in a direction tilted with respect to the horizontal direction by a tilt angle that is smaller than any other light beams.

10. The lamp of claim 1, wherein each of the plurality of light sources is disposed on one side of each of the plurality of reflectors such that each light beam is emitted in a left and right direction.

11. The lamp of claim 1, wherein the plurality of light sources are turned on or off simultaneously.

12. The lamp of claim 1, wherein the plurality of light sources are turned on or off sequentially.

13. The lamp of claim 1, wherein at least two of the plurality of light sources respectively generate at least two light beams having different brightness.

14. The lamp of claim 1, wherein the plurality of optical modules further include a plurality of shields having transmissive regions formed therein to transmit at least a portion of the plurality of light beams, and wherein a transmissive region, which transmits a light beam irradiated to a point disposed farther from the vehicle than any other light beams, is formed larger than any other transmissive regions.

* * * * *